US005806155A

United States Patent [19]

Malaney et al.

[11] Patent Number: 5,806,155

[45] Date of Patent: Sep. 15, 1998

[54] APPARATUS AND METHOD FOR HYDRAULIC FINISHING OF CONTINUOUS FILAMENT FABRICS

[75] Inventors: Frank E. Malaney, Charlotte, N.C.; Frederick Ty, Walpole, Mass.; Herschel Sternlieb, Brunswick, Me.; Gregory Henning, Charlotte, N.C.

[73] Assignee: International Paper Company, Purchase, N.Y.

[21] Appl. No.: 487,261

[22] Filed: Jun. 7, 1995

[51] Int. Cl.[6] ..... D04H 1/46

[52] U.S. Cl. ..... 28/167; 28/104; 8/151

[58] Field of Search ..... 8/151.2, 151; 28/104, 28/167

[56] References Cited

U.S. PATENT DOCUMENTS

| | | | |
|---|---|---|---|
| 2,150,652 | 3/1939 | Foster . | |
| 2,317,375 | 4/1943 | Graham . | |
| 2,338,983 | 1/1944 | Thackston et al. . | |
| 2,342,746 | 2/1944 | Masland, 2D . | |
| 2,372,048 | 3/1945 | Auxier . | |
| 2,561,449 | 7/1951 | Ruderman . | |
| 2,583,855 | 1/1952 | Kenis . | |
| 2,688,006 | 8/1954 | Steinman . | |
| 2,911,747 | 11/1959 | Sundt . | |
| 2,981,999 | 5/1961 | Russell . | |
| 2,991,537 | 7/1961 | Moler et al. . | |
| 3,010,179 | 11/1961 | Thal . | |
| 3,060,549 | 10/1962 | Horton . | |
| 3,085,027 | 4/1963 | Porteous . | |
| 3,449,809 | 6/1969 | Hyunkook Shin . | |
| 3,485,706 | 12/1969 | Evans | 161/72 |
| 3,485,708 | 12/1969 | Ballou et al. . | |
| 3,493,462 | 2/1970 | Bunting, Jr. | 161/169 |
| 3,494,821 | 2/1970 | Evans . | |
| 3,503,134 | 3/1970 | Fleissner . | |
| 3,613,999 | 10/1971 | Bently et al. | 239/553.3 |
| 3,617,613 | 11/1971 | Benzinger . | |

(List continued on next page.)

FOREIGN PATENT DOCUMENTS

| | | | |
|---|---|---|---|
| 974745 | 1/1975 | Canada . | |
| 1025013 | 10/1978 | Canada . | |
| 0-010-546-A1 | 5/1980 | European Pat. Off. . | |
| 0-177-277 | 4/1986 | European Pat. Off. . | |
| 0-193-078-A1 | 9/1986 | European Pat. Off. . | |
| 25-46-642 | 4/1977 | Germany . | |
| 54-11433 | 5/1979 | Japan . | |
| 57-22692 | 1/1982 | Japan . | |
| 57-35051 | 2/1982 | Japan . | |
| 59-196243 | 9/1984 | Japan . | |
| 61-24487 | 2/1986 | Japan . | |
| 61-213142 | 9/1986 | Japan . | |
| 61-252339 | 11/1986 | Japan . | |
| 61-58573 | 12/1986 | Japan . | |
| 62-104196 | 5/1987 | Japan . | |
| 498047 | 2/1939 | United Kingdom . | |
| 2-047-291 | 11/1980 | United Kingdom . | |
| WO 89/09850 | 10/1989 | WIPO | 28/104 |
| WO9534447 | 12/1995 | WIPO . | |

OTHER PUBLICATIONS

Ellis, T.L., "Lamination Process", IBM Technical Disclosure, vol. 10, No. 1, p. 12 (Jun. 1967).

Reed, L.J., "Etching of Epoxy Glass Curcuit Board", IBM Technical Disclosure, vol. 6 No. 8, p. 82 (Jan. 1964).

*Primary Examiner*—Andy Falik

*Attorney, Agent, or Firm*—Ostrager, Chong & Flaherty

[57] ABSTRACT

An hydraulic treatment apparatus (10) and method is provided for finishing and upgrading the quality of continuous filament cloth materials. The fabric (12) is supported on a member and impacted with a uniform, high density jet, fluid curtain (34,70) under controlled process energies. Low pressure/low energy treatments spread filaments in the fabric to reduce air porosity and provide improved uniformity in material finish. High pressure and energy treatments increase fabric bulk and porosity. Fluid treated fabrics of the invention demonstrate substantial improvement in at least two of uniformity, cover, opacity, increased or decreased bulk, increased or decreased air permeability, abrasion resistance, tensile strength, edge fray, and seam slippage.

49 Claims, 9 Drawing Sheets

U.S. PATENT DOCUMENTS 3,733,239 5/1973 George .
3,895,158 7/1975 Gause et al. .
4,069,563 1/1978 Contractor et al. ..... 28/105
4,087,993 5/1978 Sando et al. .
4,092,453 5/1978 Jonda .
4,190,695 2/1980 Niederhauser .
4,233,349 11/1980 Niederhauser .
4,290,766 9/1981 Burns, Jr. et al. .
4,304,813 12/1981 Elmore, Jr. .
4,314,002 2/1982 Oizumi et al. .
4,389,453 6/1983 Kitanaka et al. .
4,407,883 10/1983 Newton .
4,428,995 1/1984 Yokono et al. .
4,452,847 6/1984 Siemon .
4,477,512 10/1984 Thomas et al. .
4,497,095 2/1985 Minemura et al. .
4,497,097 2/1985 Schneider et al. .
4,501,787 2/1985 Marchetti et al. .
4,513,055 4/1985 Leibowitz .
4,543,113 9/1985 Forester et al. ..... 55/378
4,548,848 10/1985 Shibata et al. ..... 428/85
4,550,051 10/1985 Spielau et al. .
4,563,385 1/1986 Bhatt et al. .
4,647,490 3/1987 Bailey et al. ..... 28/104
4,684,569 8/1987 McGee, Jr. .
4,707,565 11/1987 Kasai et al. .
4,743,483 5/1988 Shimizu et al. .
4,770,922 9/1988 Hatakeyama et al. .
4,789,770 12/1988 Kasner et al. .
4,828,174 5/1989 Love, III .
4,833,005 5/1989 Klaar et al. .
4,880,168 11/1989 Randall, Jr. ..... 239/553.5
4,900,614 2/1990 Miyazato et al. .
4,921,735 5/1990 Bloch ..... 139/389
4,932,107 6/1990 Gotoh et al. ..... 28/137
4,937,925 7/1990 McGee, Jr. .
4,960,630 10/1990 Greenway et al. .
4,967,456 11/1990 Sternlieb et al. .
4,977,016 12/1990 Thornton et al. .
4,980,217 12/1990 Grundfest et al. .
4,995,151 2/1991 Siegel et al. .
5,010,663 4/1991 Thornton et al. .
5,011,183 4/1991 Thornton et al. .
5,023,130 6/1991 Simpson et al. .
5,030,493 7/1991 Rich .
5,033,143 7/1991 Love, III .
5,042,722 8/1991 Randall, Jr. ..... 239/553.5
5,071,701 12/1991 Tenney et al. .
5,073,418 12/1991 Thornton et al. .
5,080,952 1/1992 Willbanks .
5,098,125 3/1992 Thornton et al. .
5,098,764 3/1992 Drelich et al. .
5,117,069 5/1992 Higgins, III .
5,131,434 7/1992 Krummheuer et al. ..... 139/35
5,136,761 8/1992 Sternlieb et al. .
5,142,753 9/1992 Bolliand et al. .
5,143,771 9/1992 Fourezon .
5,168,006 12/1992 Inoguchi et al. .
5,173,360 12/1992 Hiroe et al. .
5,217,796 6/1993 Kasai et al. .
5,235,733 8/1993 Willbanks et al. ..... 28/105
5,252,386 10/1993 Hughes et al. .
5,277,230 1/1994 Sollars, Jr. ..... 139/389
5,281,441 1/1994 Kasai et al. ..... 427/300
5,292,573 3/1994 Adams, Jr. et al. .
5,320,760 6/1994 Freund et al. .
5,337,460 8/1994 Cockfield et al. .
5,356,680 10/1994 Krummheuer et al. ..... 428/36.1
5,397,627 3/1995 Dunbar et al. ..... 428/229
5,542,703 8/1996 Beasley ..... 280/739
5,554,424 9/1996 Krummheuer et al. ..... 428/35.2
5,557,831 9/1996 Kishi et al. ..... 28/167
5,566,434 10/1996 Beasley ..... 28/112
5,630,261 5/1997 Beasley .
5,632,072 5/1997 Simon et al. .
5,657,520 8/1997 Greenway et al. .

10
12
14
16
18
20
22
24
26
30
32
34
35
36
38
40
42
44
46
48
50
52
54
56
72
74
76
78
80

FIG. 3
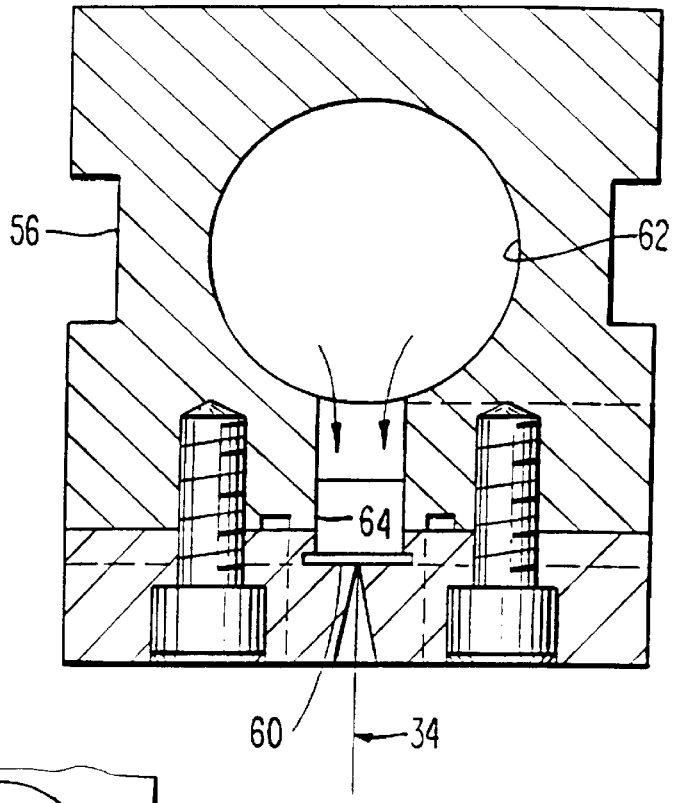
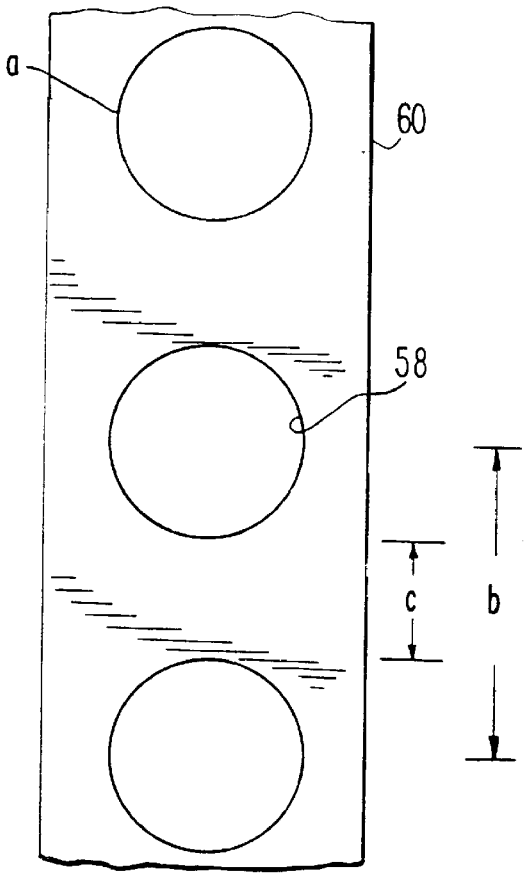
FIG. 4A

Sample A Control

Sample A 200 psi

Sample A 300 psi

Sample A 1500 psi

APPARATUS AND METHOD FOR HYDRAULIC FINISHING OF CONTINUOUS FILAMENT FABRICS

FIELD OF THE INVENTION

This invention generally relates to a finishing process for improving the uniformity and physical properties of flat, microdenier, conjugate, and textured filament fabrics. More particularly, it is concerned with an hydraulic fluid treatment process which imparts improved uniformity, controlled porosity and improved texture in filament fabrics.

BACKGROUND OF THE INVENTION

Conventional filament fabrics are composed of two sets of yarns, warp and filling, that are formed by weaving and interlacing the yarns. Filaments within the weave are composed of continuous fibers of indefinite length which are assembled in bundles with or without twist. Various types of filament fabrics are engineered by employing conventional weave constructions, which include plain, twill and satin weaves. Other effects in such woven materials are obtained through use of varying types of yarns.

Woven filament fabrics are widely used in diverse industries including, protective apparel, marine fabrics, passenger restraint bags for automobiles ("airbags"), computer circuit board composite materials, printer ribbons, filter materials, window coverings, bedspreads, men's and women's apparel and various other cloths. Filament yarns used in these materials are made of a variety of materials including manufactured fibers such as nylon, polyester, polyethylene, high molecular weight polyethylene, rayon and glass.

For various fabric applications, it is beneficial to provide materials which have uniform textures and low permeabilities. For example, in automobile airbags it is essential that fabrics be engineered to precise permeabilities to provide for controlled gas inflation and deflation. Similarly, in protective apparel for medical and other applications controlled permeabilities are essential to provide adequate barrier properties.

It has been found that conventional weaving techniques do not provide filament fabrics with sufficient uniformity and consistent permeability features. To improve the uniformity and other properties of filament materials it has been necessary to employ various finishing coatings. For example, in filament cloth for airbags, it is common practice to apply resin binders to reduce permeability in the fabric. Such coated materials are not satisfactory because of reduced flexibility, increased weight and long term instability.

As an alternative to coating techniques, the art has recently proposed that filament cloths can be thermally calendared to obtain improved uniformity and reduced permeability. Thermal calendaring techniques for application to filament materials are disclosed in U.S. Pat. Nos. 5,073,418 and 5,010,663, both to Thornton et al., which are directed to materials having specific application in automobile airbags. However, this technique is not entirely satisfactory because calendaring denigrates the tensile and tear properties of the fabric.

Hydroenhancement techniques have been developed for enhancing the surface finish and texture, durability, and other characteristics of woven or knit spun and spun filament yarn fabric. For example, such techniques are described in commonly owned U.S. Pat. Nos. 4,967,456 and 5,136,761 of H. Sternlieb et al. The hydroenhancing process generally includes exposing one or both surfaces of a fabric to fluid jet treatment, followed by removal of moisture from the fabric and drying. During hydroenhancement, the high pressure water jets impact upon the spun yarns and cause them to bulk or bloom and the fibers in yarn to become interentangled. Fabrics produced by this hydraulic treatment process have enhanced surface finish and improved characteristics such as cover, abrasion resistance, drape, stability as well as reduced air permeability, wrinkle recovery, seam slippage and edge fray. Hydroenhancing technology is not suitable for 100 percent filament based fabrics because filaments within the fabric do not have free fiber ends which are capable of entanglement.

It is known in the art that hydraulic treatment improves surface smoothness and uniformity of filament fabrics. This art is represented by U.S. Pat. Nos. 4,707,565, 5,217,796, and 5,281,441 to Kasai et al. which disclose hydraulic treatment of glass filament materials used in electronic circuit boards. Conventional circuit boards include a metal foil mounted onto a multiple layer laminate of filament glass fabric materials impregnated with synthetic resin. Hydraulic processes are employed in Kasai to spread and open filaments in the fabrics to improve resin impregnation. Hydraulic apparatus employed in the Kasai patents employ rotary nozzle mechanisms.

It is believed that the Kasai process is deficient in that it fails to achieve uniform improvement in fabric properties. Moreover, the Kasai process is not satisfactory for engineering filament fabrics to uniform and controlled porosity specifications.

U.S. Pat. No. 5,73,360 to Hiroe et al. discloses a hydraulic fluid treatment process for improving the "smoothness" of continuous filament fabric having application for use in ink ribbons. This teaching is particularly directed to processing of low twist, and high warp density filament fabrics which have ink ribbon application.

Accordingly, it is the broad object of the present invention to provide an hydraulic treatment process and related apparatus for production of woven filament fabrics which have improved uniformity and physical properties.

A more specific object of the invention is to provide an hydraulic treatment process for improving the texture, bulk and permeability properties of woven filament fabrics.

Another object of the invention is to provide an hydraulic treatment process which can uniformly increase or decrease air porosity of filament fabrics to precise specifications.

A further object of the invention is to provide an hydraulic production line apparatus which is less complex and improved over the prior art.

SUMMARY OF THE INVENTION

In the present invention, these purposes, as well as others which will be apparent, are achieved generally by providing an apparatus and related method for hydraulic treatment of woven filament fabrics through dynamic fluid action. An hydraulic treatment apparatus is employed in the invention in which the fabric is supported on a member and impacted with a uniform, high density jet, fluid curtain under controlled process energies. According to the invention, energy and pressure process parameters are correlated to fabric porosity in finished fabrics. Low pressure/low energy treatments spread filaments in the fabric to reduce air porosity and provide improved uniformity in material finish. High pressure and energy treatments increase fabric bulk and porosity. Fluid treated fabrics of the invention demonstrate substantial improvement in at least two of uniformity, cover, opacity, increased or decreased bulk, increased or decreased air permeability, abrasion resistance, tensile strength, edge fray, and seam slippage.

According to the preferred method of the invention, the filament fabric is advanced on a process line through (i) a scouring station to clean and remove sizing and dirt from the fabric, (ii) a pre-tentering station to stretch the fabric to a pre-determined excess width to compensate for shrinkage associated with the fluid treatment, (iii) two in-line hydraulic stations for fluid treatment of top and bottom surfaces of the fabric, and (iv) a post-tentering station to stretch the fabric to a desired output width. Tentering treatments are optional and are preferred for fabrics which have stretch characteristics. Such tentering processing is generally not employed in finishing non-stretchable or limited stretch fabrics.

An apparatus for practicing the invention comprises a continuous line including, scouring, hydraulic treatment, and tentering stations which are adapted for continuous fabric processing. The hydraulic treatment stations preferably include a plurality of cross-directionally ("CD") aligned and spaced manifolds in which are mounted fluid jets. A continuous curtain for the process of the invention is provided by a high density spacing of jet nozzles substantially across each of the manifolds. The fluid jets, which are preferably columnar in configuration, are provided by jet nozzles or orifices which have a diameter of 0.0081 to 0.0229 cm (0.0032 to 0.009 inches), and center-to-center spacing of 0.0244 to 0.0635 cm (0.0096 to 0.025 inches). The fluid curtain preferably impacts the fabric with a sufficient energy in the range of $1.1466\times10^4$–$22.932\times10^6$ joule/kg (0.002–4.0 hp-hr/lb), and preferably $2.8665\times10^5$ to $9.1728\times10^6$ joule/kg (0.05–1.6 hp-hr/lb). It is preferred to employ jet pressures in the range of 689 to 20,685 kpa (100 to 3000 psi). The line operates at a speed in the range of 0.0508 to 4.064 m/sec (10 to 800 fpm), and preferably 0.762 to 3.048 m/sec (150 to 600 fpm). At the process energies and line speeds of the invention, the arrangement of densely spaced jets provides a curtain of fluid which yields a uniform fabric finish.

The finishing process of the invention has application for finishing filament cloth materials. Fabrics of the invention may be woven employing conventional weaving techniques of filament yarns including olefinic, inorganic, polyester, polyamide, polyethylene, high molecular weight polyethylene, aramid, cellulosic, lyocell, acetate and acrylic fibers.

Other objects, features and advantages of the present invention will be apparent when the detailed description of the preferred embodiments of the invention are considered in conjunction with the drawings which should be construed in an illustrative and not limiting sense as follows:

BRIEF DESCRIPTION OF THE DRAWINGS

FIG. 3 is a cross-sectional view of a manifold employed in an hydraulic treatment module of the invention;

DESCRIPTION OF THE PREFERRED EMBODIMENTS

The hydraulic apparatus, related method and products of the invention obtain a controllable uniformity and porosity in woven filament materials by the application of non-compressible fluid under pressure to the fabric which is carried on a support member. The invention applies a continuous curtain of water to conventional filament cloth materials to obtain improved uniformity in yarn spacing and associated "controlled porosity" in the fabric. It should be understood that the principles of the invention have general application to all filament fabric types which have woven components, including woven/nonwoven composite materials.

Figure 1:
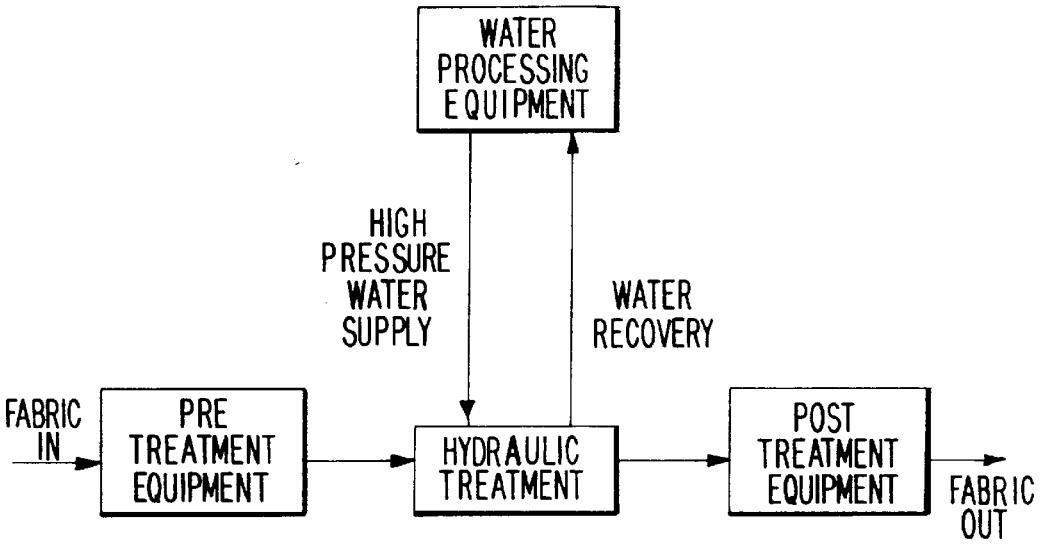
FIG. 1 is a schematic diagram of the process steps for hydraulic finishing woven filament fabric in accordance with the invention.

With reference to the general process steps of the invention as illustrated in FIG. 1, the fabric is first subjected to required pre-treatment processes, which may include washing to remove dirt and sediments, and scouring to remove fabric sizing. To compensate for shrinkage in the fabric associated with subsequent hydraulic processing, the fabric may also be pre-tentered to stretch it to a shrink compensating excess width. The pre-treated fabric is then advanced to an hydraulic treatment station in which the fabric is supported on a member and impacted with a continuous curtain of a non-compressible fluid, such as water. Following hydraulic treatment, the fabric is advanced to a post-treatment station and subjected to any required finishing processing which may include, for example, post tentering to obtain a fabric of the desired output width, and padder application of finishing treatments.

In order to obtain "controlled porosities" in fabrics of the invention it is necessary to impact the fabric with a uniform, high density jet, fluid curtain under controlled process energies. The porosity in finished fabrics correlates to energy and pressure process parameters. To obtain demonstrable improvements in fabric properties the fluid curtain should comprise a dense and uniform array of jets which impact the entire width of the fabric. The fabric must also be impacted with a cumulative process energy in the range of $1.1466\times10^4$–$22.932\times10^6$ joule/kg (0.002–4.0 hp-hr/lb) and preferably $2.8665\times10^5$ to $9.1728\times10^6$ joule/kg (0.05–1.6 hp-hr/lb), and jet pressures in the range of 689 to 20,685 kpa (100 to 3000 psi) for effective finishing treatment in the invention.

Figure 2:
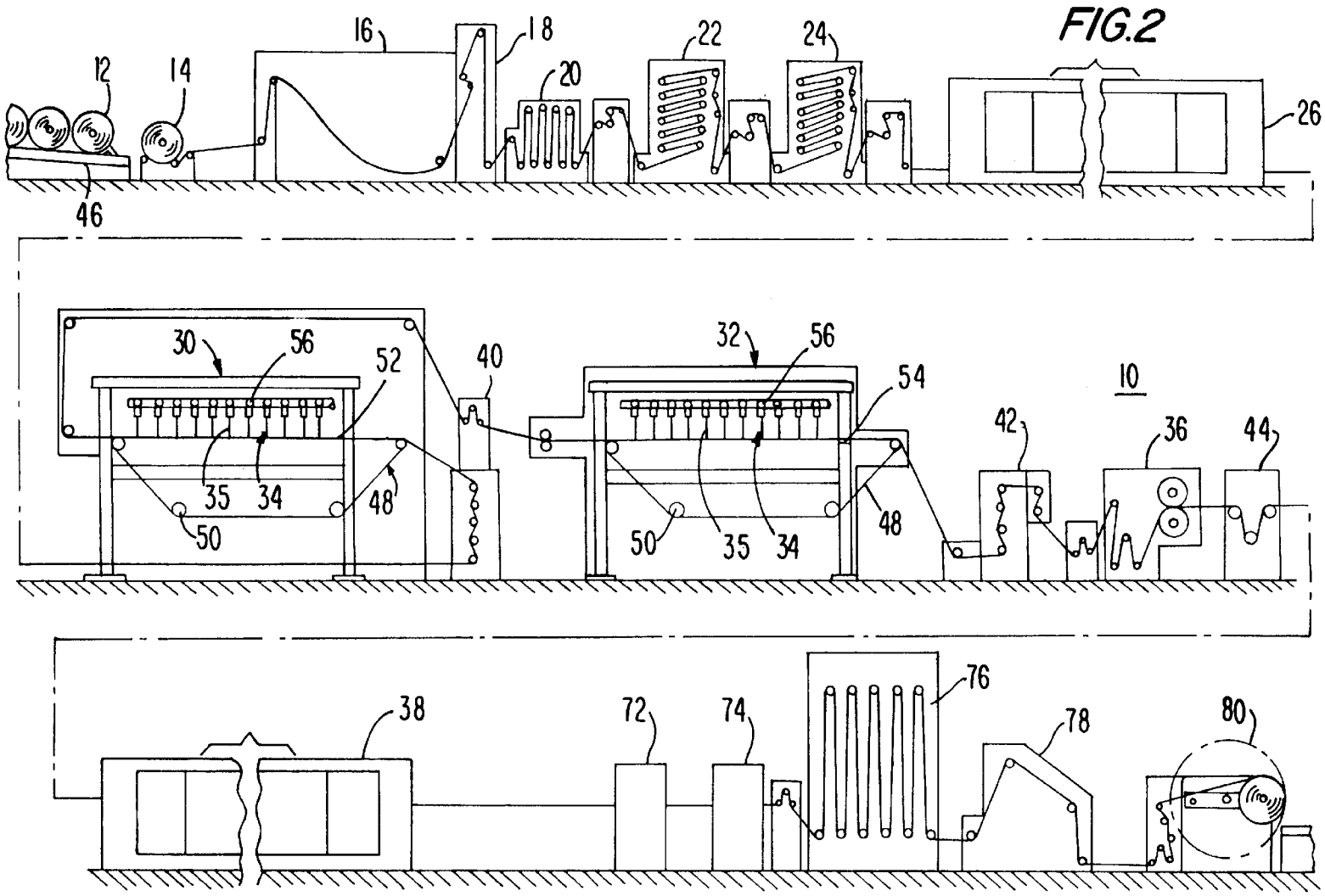
FIG. 2 is a side elevational view illustrating a preferred embodiment of a production line for hydraulic finishing of filament materials of the invention.

Referring now to FIG. 2, there is illustrated one preferred form of hydraulic finishing apparatus line of the invention, generally designated 10. The production line includes pre-treatment stations for processing the fabric 12 including, unwind station 14, scray 16, edge guide 18, saturator 20, washer or scouring stations 22, 24, and pre-tenter station 26. Following pre-treatment processing the fabric is advanced through hydraulic treatment modules 30, 32 which impact the fabric, preferably on both sides, with a fluid curtain 34. Following hydraulic processing the fabric is advanced to post-treatment stations which may include a padder 36 and tenter frame dryer 38. Further stations which are preferred for use on the line include weft straighteners 40, 42 which are respectively positioned on the line between modules 30, 32 and before padder station 36. A vacuum extractor station 44 may be positioned following the padder station 36. An optical inspection station (not shown) for monitoring the fabric for defects and contaminants may be provided between the scray 16 and saturator 20. It will be appreciated by those skilled in the art that additional edge guide stations may be employed in the line to center the fabric with centerline of the apparatus line.

Turning first to the pre-treatment stations of the line. Fabric rolls are received in unwind station 14 where the fabric rolls are placed, in succession, on roll feed table 46. In order to provide a continuous processing line capability, the fabric is advanced to a scray apparatus 16 in which in the beginning and end sections of successive rolls are joined together by conventional sewing techniques.

From the scray 16, the fabric is advanced to saturator 20 and scouring or washers 22, 24 to clean the fabric prior to hydraulic treatment and, if required to remove sizing and tint which are generally used in the weaving of fabrics. The saturator and washing apparatus are preferably provided with regulated temperature controls and scouring water temperatures of up to 195 degrees Fahrenheit.

Following the scouring treatment, the fabric is pre-tentered (stretched) at pre-tenter station 26 to a predetermined width in excess of a desired finished width of the fabric. The pre-tentering width is selected so that the expected shrinkage caused by the hydraulic treatment process reduces the width of the finished fabric to slightly less than the desired finished width. The post-tenter or tenter frame dryer 38 is used to post-tenter the fabric after hydraulic processing only by a slight amount to the exact desired finished width.

The preferred process line of the invention is provided with two in-line hydraulic treatment modules 30, 32. As shown in FIG. 2, the fabric is first fluid treated on one side in module 30 and then, advanced to module 32 for treatment of its reverse side. Each module 30, 32 includes an endless conveyor 48 driven by rollers 50 and tensioning guide mechanisms (not shown) which advance the fabric in a machine direction on the line. The conveyor 48 in each module presents a generally planar support member, respectively designated 52, 54 in modules 30, 32, for the fabric in the hydraulic treatment zone of the module.

The support members 52, 54 preferably have a substantially flat configuration, and may be solid or include fluid pervious open areas (not shown). The preferred support members 52, 54 for use in the invention are a plain mesh weave screen. For example, a conventional mesh stainless steel or plain weave screen formed of polyester warp and shute round filament. The fabric is supported in contact with screen while open areas drain away water applied to the fabric, as described further below. In the preferred embodiments, the open areas occupy approximately 12 to 40 percent of the screen.

Conventional filament fabrics have reed markings and other irregularities associated with their production. The invention overcomes these defects in a two stage hydraulic finishing process which stabilizes the fabric by uniformly spacing filament yarns in the fabric weave. Further advantage is obtained by use of support members 52, 54 which include fine mesh screens which have a variety of contoured weave patterns which may include, for example a twill weave.

Each module 30, 32 includes an arrangement of parallel and spaced manifolds 56 oriented in a cross-direction ("CD") relative to movement of the fabric 12. The manifolds which are spaced approximately 20.3 cm (8 inches) apart each include a plurality of closely aligned and spaced columnar jet orifices 58 (shown in FIG. 4A) which are spaced approximately 1.27 to 2.45 cms (0.5 to 1 inches) from the support members 52, 54. A preferred manifold structure employs a jet strip 60 which is provided with precisely calibrated jet orifices which define the jet array.

Figure 5:
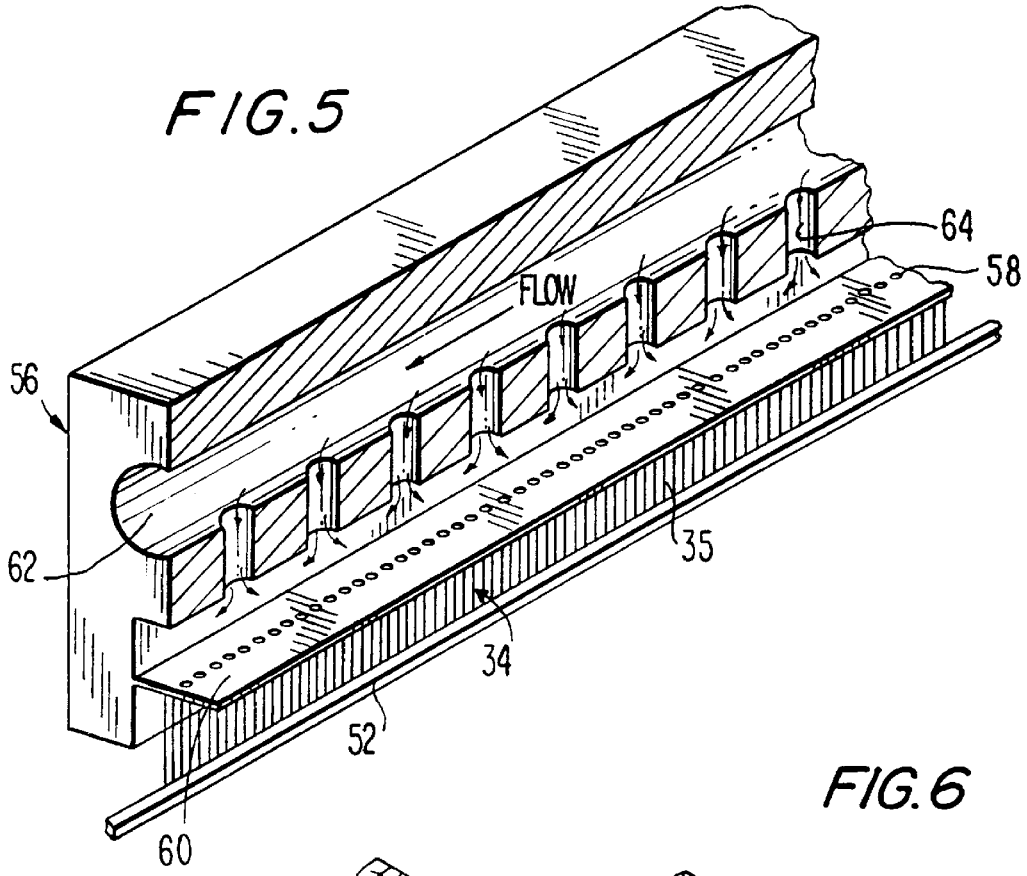
FIG. 5 is a partial isometric view of the manifold of FIG. 3 showing a jet strip structure and columnar fluid curtain employed in the invention.

FIG. 3 shows a cross-section of a preferred manifold structure for use in the invention. High pressure is directed through the main plenum 62 to distribution holes 64. As best shown in FIG. 5, the jet strips 60 are mounted in the manifold to provide a dynamic fluid source for the jet strips. The jet orifices preferably have diameters and center-to-center spacings in the range of 0.0081 to 0.0229 cm (0.0032 to 0.009 inches), and center-to-center spacing of 0.0244 to 0.0635 cm (0.0096 to 0.025 inches), respectively, and are designed to impact the fabric with fluid pressures in the range of 689 to 20,685 kpa (100 to 3000 psi).

Figure 4B:
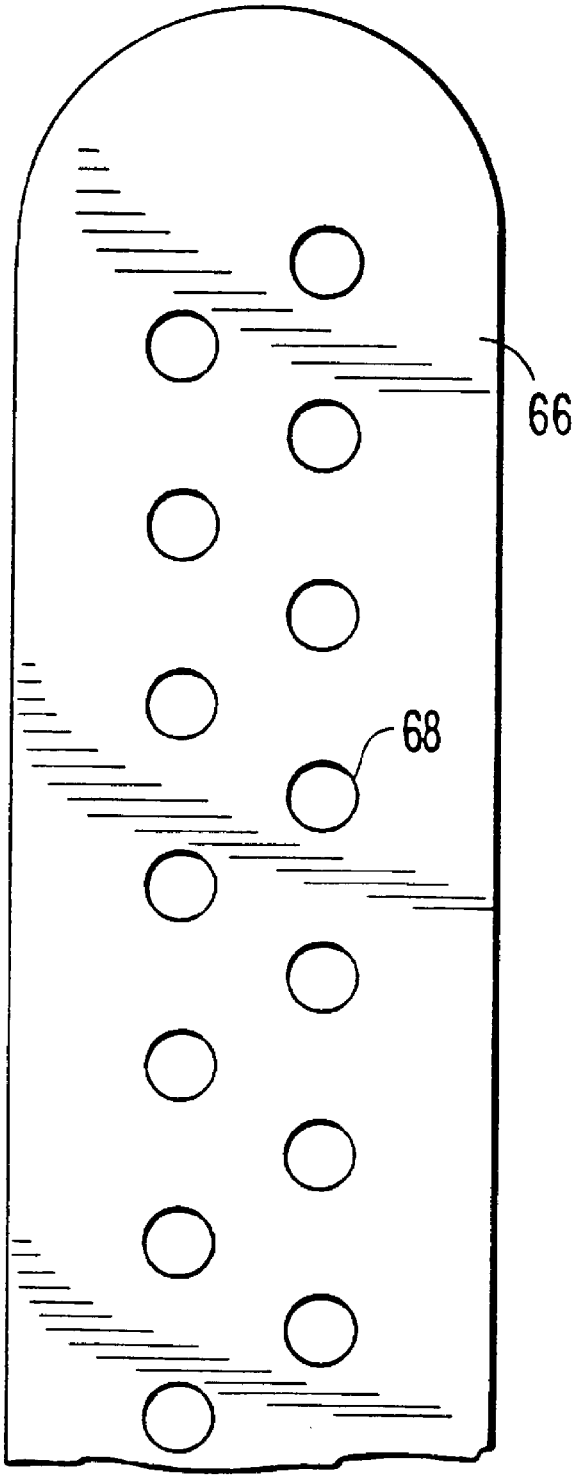
FIGS. 4A and B show alternative jet strip orifice configurations which may used in the manifold structure of FIG. 3.

FIG. 4A shows a preferred jet strip 60 which includes a dense linear array of jet orifices 58. A preferred jet strip 60 includes jet orifices which have a diameter ("a") of 0.0081 cms (0.0032 inches), center-to-center spacing ("b") of 0.0244 cms (0.0096 inches), and are spaced apart a distance ("c") of 0.0163 cms (0.0064 inches). It is believed that advantage is obtained by employing a uniform and extremely dense array of jets. A preferred density for the linear jet array would be in the approximate range of 61 to 104 orifices per inch. FIG. 4B shows an alternative jet strip 66 which includes staggered linear arrays of jet orifices 68. This staggered arrangement obtains an increased jet orifice density of approximately 122 to 208 orifices per inch.

Energy input to the fabric is cumulative along the line and preferably set at approximately the same level in modules 30, 32 to impart uniform hydraulic treatment to the fabric. Within each module advantage may be obtained by ramping or varying the energy levels from manifold to manifold. According to the invention, the fluid curtain 34 is uniform and continuous in the cross direction of the line. As will more fully described hereinafter, the fluid curtain preferably comprises a dense array of columnar fluid jets 35. Energy specifications for the fluid curtains are selected to correlate with desired end physical properties in finished fabric.

In the hydraulic modules, the fabric is preferably impacted with uniform fluid on both top and bottom sides. Energy requirements for effective fabric finish vary as a function fabric type, composition, weave, and weight. Accordingly, it is necessary to employ a cumulative process energy which is sufficient for a select fabric work piece to improve the uniformity of yarn spacing within the fabric. Demonstrable improvements in physical properties are obtained in the invention within the energy range of $1.1466\times10^4$–$22.932\times10^6$ joule/kg (0.002–4.0 hp-hr/lb), and preferably $2.8665\times10^5$ to $9.1728\times10^6$ joule/kg (0.05–1.6 hp-hr/lb).

Figure 6:
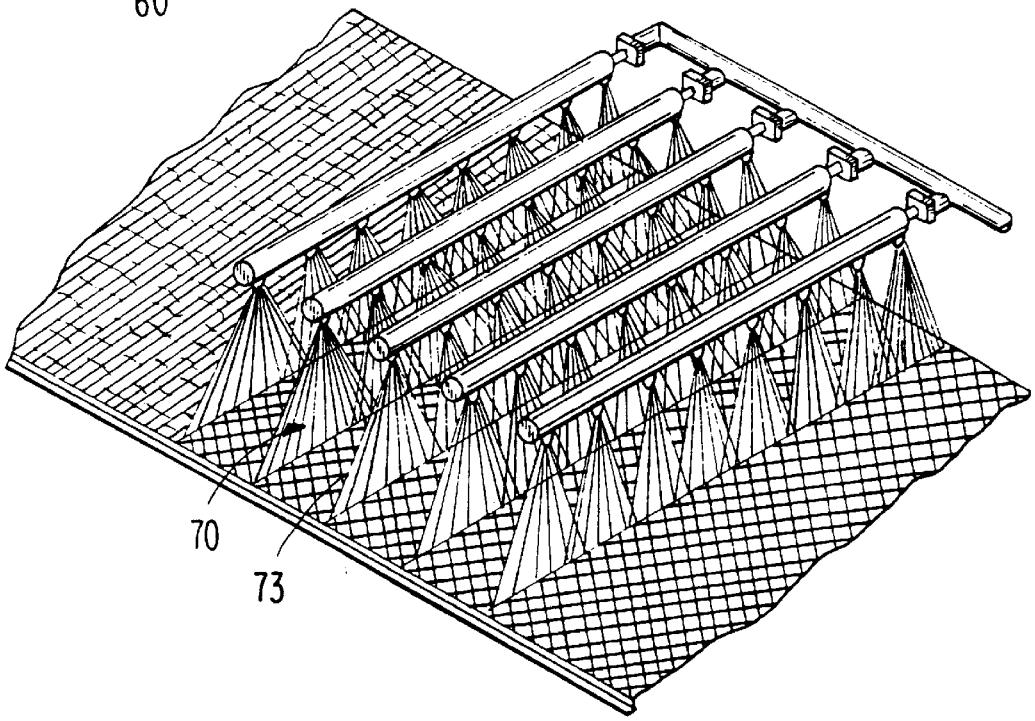
FIG. 6 is a perspective view of an alternative manifold arrangement of the invention including a fluid curtain formed by overlapping fan jets.
Figure 7A:
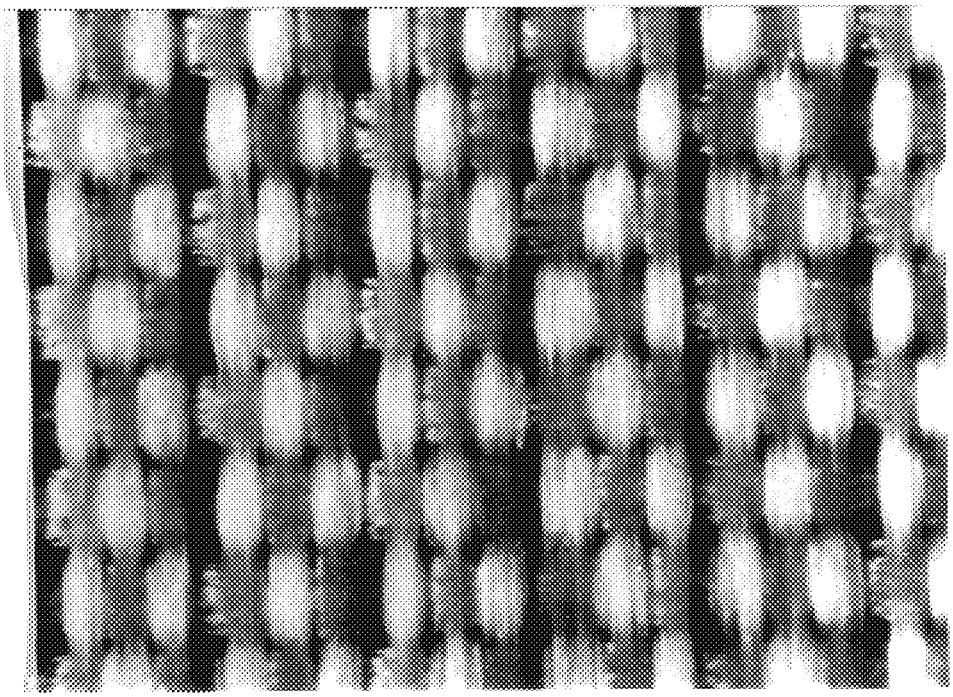
FIGS. 7A and B are photomicrographs at 55× magnification of a control and hydraulically processed nylon filament fabric in accordance with Example 3.
Figure 7B:
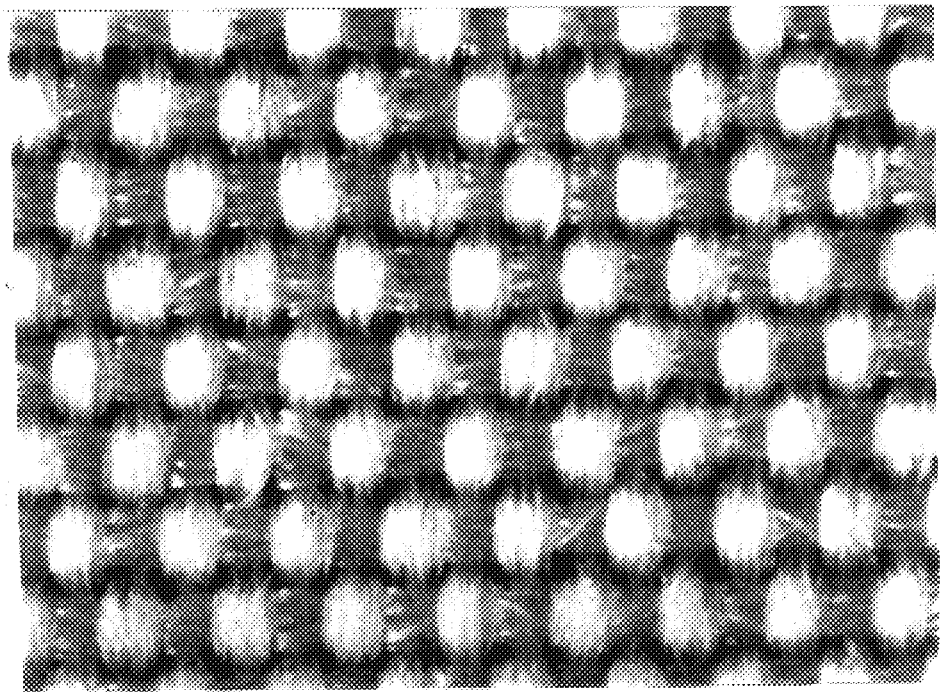

A preferred schematic of the fluid curtain is best shown in FIG. 5 wherein columnar jets 35 are shown a dense array positioned in the cross-direction of production line 10. The columnar jets in the curtain have a generally perpendicular orientation to a support member. FIG. 6 shows an alternative fluid curtain 70 including divergent or angled fluid jets 73.

This arrangement provides a tentering effect in the hydraulic process to stabilize the fabric matrix.

Following hydraulic treatment the fabric may be advanced for post-treatment through the weft straightener 42, padder 36, vacuum extractor 44, and tenter frame dryer station 38. For example, at padder station 36 conventional resins and finishing treatments may be applied to the fabric 12. A feature of the invention is the use of a combination of pre- and post-treatment tenter frame processing to control shrinkage associated with the hydraulic treatment.

Following tenter drying, the fabric 12 is advanced to inspection stations which may include, a weft detector 72 to sense fabric straightness, moisture detectors (not shown) and optical 74 equipment to monitor the fabric for possible defects. FIG. 2 also shows a fabric accumulator 76, operator inspection station 78 and fabric wind-up station 80.

Hydraulic processing according to the invention may be practiced on conventional filament yarn woven fabrics. Filament yarns suitable for use in the invention fabrics may be selected from the material groups comprising olefinic, inorganic, polyester, polyethylene, high molecular weight polyethylene, polyamide, aramid, cellulosic, lyocell, acetate and acrylic fibers.

It will be recognized that advantage can be obtained in the invention by specification of filament yarn types for use in the invention fabrics. Conventional filament yarns are composed of continuous filaments assembled with or without twist. For example, flat, microdenier, and conjugate yarn constructed fabrics, respectively, have applications which include use in protective apparel, marine fabrics, passenger restraint bags for automobiles, computer circuit board composite materials, filtration materials, window coverings, bedspreads, printer ribbons, men's and women's apparel, and various other cloths. Fabrics which include yarns of low twist are generally found to more demonstrably respond to hydraulic processing.

Prior art hydraulic techniques having application to upgrade the quality of spun yarn fabrics are disclosed in commonly owned U.S. Pat. Nos. 4,967,456 and 5,136,761 of H. Sternlieb et al., which are incorporated herein by reference. According to the teachings of this art, high pressure water jets impact upon the spun yarns and cause them to bulk or bloom and interentangle fiber ends in the spun yarn.

Filament fabrics do not have fiber ends which entangle in response to hydraulic treatment. However, in the present invention it is found that hydraulic entanglement effects can be simulated by using fabrics which include texturized yarns. Such yarns have loops, coils or folded portions which interentangle in response to hydraulic processing. Advantageously, hydraulic processing of texturized filament content fabrics yields substantial improvements in fabric tensile characteristics and cover.

An advance in the present invention resides in providing an hydraulic treatment process which permits engineering of filament fabrics to exacting or "controlled porosity" specifications. The invention correlates fabric porosity characteristics to energy and pressure process parameters. Low pressure/low energy treatments spread filaments in the fabric to reduce air porosity and provide improved uniformity in material finish. High pressure and energy treatments increase fabric bulk and porosity. It is found that various physical properties of filament fabrics are obtained as an adjunct to stabilizing the fabric weave. In particular, fluid treated fabrics of the invention demonstrate substantial improvement in at least two of uniformity, cover, opacity, increased or decreased bulk, increased or decreased air permeability, abrasion resistance, tensile strength, edge fray, and seam slippage.

As representative of the scope of the invention, Examples are set forth below to illustrate pre-selected improvements in the physical properties in fabric work pieces. For the Examples, a prototype line was employed which simulated the two stage hydraulic modules of the invention. Prior to hydraulic processing fabrics of the Examples were scoured to clean and remove sizing from the fabric. Following hydraulic treatment, the fabrics were processed in a heat set tenter to impart a uniform width to the fabric. It will be recognized that further advantage would be obtained in the Examples with the addition, for fabrics having stretch characteristics, of pre-tenter processing of the invention.

Fabrics processed in the Examples exhibited demonstrable improvements in physical properties including, characteristics such as cover, permeability, abrasion resistance, tensile strength, stability, and reduction in seam slippage, and edge fray.

As in the line of FIG. 2, two hydraulic modules were employed for treatment of top and bottom sides of the fabric. Within each module manifolds 56 were spaced approximately 20.3 cm (8 inches) apart and provided with densely packed columnar jets. Specifications of the fluid curtain were varied in the Examples to obtain specified energy levels and illustrate the range of properties which can be altered in the invention process.

Tables I–X set forth data for fabrics hydraulically treated in accordance with invention on the test process line. Standard testing procedures of The American Society for Testing and Materials (ASTM) were employed to test control and processed characteristics of fabrics.

EXAMPLE 1

Reduction in air permeability, increased bulk and increased warp tensile.

A 100% cellulose acetate filament fabric having the following specifications was processed in accordance with the invention: 115 denier warp yarns and 150 denier weft yarns in a 120×68 plain weave construction and approximate weight of 3.03 ounces/yd$^2$.

The fabric was processed on a 100×94, 2×1 semi-twill weave stainless steel screen having a 28% open area. Manifolds used in the Example were provided with orifice strips having 0.005 inch diameter holes at a frequency of 61 holes/inch. Manifold pressure was set at 1,000 psi and line speed at 41 feet per minute. The fabric sample was passed under two manifold positions on each of its sides. A cumulative energy level of 0.5 HP hr/lb of fabric yielded the following results:

TABLE I

| | Air Perm (cfm/ft$^2$) | Bulk (Mils) | Warp Tensile (Lbs.) | Percent Fraying |
|---|---|---|---|---|
| Control (Untreated) | 38.8 | 7.7 | 39.4 | 33.8 |
| Processed | 17.1 | 8.2 | 44.6 | 9.0 |

EXAMPLE 2

Increases in air permeability, increased bulk and improved abrasion resistance.

A 100 percent texturized polyester fabric of the type used in outdoor upholstery cloth was processed in this Example to illustrate improvements in fabric cover that can be obtained in the invention. Fabric specifications include: 2-ply 150/34 denier warp and fill yarns, 58×46 construction and approximate weight of 4.6 oz./yd$^2$.

The sample fabric was passed under 6 manifold positions on each side of the fabric, and processed on a 100×94, 2×1 semi-twill weave stainless steel screen. The manifolds contained orifice strips having 0.005 inch diameter holes at a frequency of 61 holes/inch. The manifold pressure is 1500 psi and line speed is 142 feet per minute. A cumulative energy level of 0.5 hp-hr./lb of fabric produced the following results:

TABLE II

| | Air Perm (cfm/ft$^2$) | Abrasion To Hole Cycles | Bulk (mils) |
|---|---|---|---|
| Control (Untreated) | 11.5 | 1545 | 12.8 |
| Processed | 16.2 | 2536 | 15.5 |

EXAMPLE 3

Pore size reduction and uniformity improvement.

Various nylon based fabrics have application for use in printer ribbon materials. This Example illustrates use of hydraulic treatment to obtain "controlled" and "uniform" porosity fabric with improved ink holding specifications.

A 100 percent nylon filament cloth was provided with a 170×110 construction and weight of 2.1 oz/yd$^2$. The fabric is passed under three manifold positions on each side supported on a 36×28 plastic screen. The manifold is provided with orifice strips that have 0.0032 inch holes at a frequency of 104 holes/inch. A treatment energy level of 0.5 hp-hr./lb. of fabric at 1000 psi and line speed of 68 ft/min yields the following fabric pore results:

TABLE III

| | Min. Pore (Microns) | Max. Pore (Microns) | Avg. Pore (Microns) |
|---|---|---|---|
| Control (Untreated) | 7.85 | 56.2 | 20.49 |
| Processed | 6.09 | 20.7 | 9.38 |

EXAMPLE 4

Improvements in yarn slippage reduction in bulk and air permeability.

A 100 percent texturized polyester upholstery fabric was provided with a 19×17 construction and weight of 6.9 oz/yd$^2$. The fabric is passed under six manifold positions on each side supported on a 100×94 plain weave stainless steel screen. The manifold is provided with orifice strips that have 0.005 inch holes at a frequency of 61 holes/inch. A treatment energy level of 0.5 hp-hr./lb. of fabric at 1000 psi and line speed of 96 feet per minute yields the following results:

TABLE IV

| | Yarn Slippage (Lbs.) | | Bulk | Air Perm |
|---|---|---|---|---|
| | Warp | Fill | (Mils) | (CfM/Ft$^2$) |
| Control (Untreated) | 65.5 | 60.3 | 59.2 | 333 |
| Processed | 150.2 | 158.2 | 50.1 | 97 |

EXAMPLE 5

Increased air permeability, tensile, elongation and bulk with reduced pore size.

A 100% filament fabric having application for use in protective apparel was provided with the following specifications: 153×75 construction and weight of 3.7 oz/yd$^2$; warp yarn of 100 denier/50 texturized yarn and fill of 150 denier flat filament.

The fabric is passed under four manifold positions on each side supported on a 100×94 plain weave stainless steel screen. Manifolds are provided with orifice strips that have 0.005 inch holes at a frequency of 61 holes/inch. Table V sets forth results obtained at a treatment process energy of 0.5 hp-hr./lb., pressure of 700 psi and line speed of 41 fpm.

TABLE V

| | Pore Size (Micron) | | | Bulk | Air Perm | Tensile (Lbs.) | | Elongation % | |
|---|---|---|---|---|---|---|---|---|---|
| | Max. | Min. | Avg. | Mils | (CFM/FT$^2$) | Warp | Weft | Warp | Weft |
| Control (Untreated) | 112.2 | 4.7 | 8.4 | 9.4 | 3.2 | 139.4 | 40.4 | 31.7 | 23.3 |
| Processed | 62. | 3.8 | 5.7 | 12.3 | 6.7 | 151.9 | 53.4 | 50.7 | 28.4 |

TABLE VI

| | Energy | Bulk | Air Perm | Tensile (Lbs) | | Elongation % | |
|---|---|---|---|---|---|---|---|
| | Hp-hr/lb | Mils | CFM/FT$^2$ | Warp | Weft | Warp | Weft |
| Control (Untreated) | 0 | 11.6 | 1.7 | 306 | 258 | 30.5 | 32.6 |
| Processed 1. | 0.2 | 15.5 | 7.6 | 361 | 335 | 37.6 | 36.9 |
| Processed 2. | 0.6 | 18.8 | 10.4 | 353 | 305 | 38.9 | 39.9 |
| Processed 3. | 1.2 | 20.9 | 14.1 | 371 | 329 | 42.8 | 43.8 |

EXAMPLE 6

Controlled, increased air permeability, bulk, tensile and percent elongation.

A nylon filament fabric constructed of flat filaments having a 47×45 construction and weight of 5.4 oz/yd$^2$ is processed in this Example employing a fluid curtain having a ramped energy distribution. Hydraulic treatment specifications include manifolds having 0.005 inch diameter holes with a density of 61 holes per inch., a 100×94 stainless steel screen, fluid pressure of 1500 psi and line speed of 52 fpm. A cumulative treatment energy of 2.0 Hp-hr/lb was applied to the fabric at a pressure of 1500 psi. The fabric was treated one manifold on each side for 0.2 Hp-hr/lb, three manifolds per side for 0.6 HP-hr/lb, and six manifolds per side for 1.2 HP-hr/lb. Table VI shows data for changes in physical properties of the fabric at each energy level of the process.

EXAMPLE 7

Control air permeability, improved fabric uniformity, and increased seam strength.

Various nylon based fabrics have application in automobile restraint systems. This Example illustrates use of hydraulic treatment to obtain "controlled" and uniform porosity fabric specifications. Fabrics were processed employing the hydraulic treatment parameters of Example 4. Table VII sets forth test results for control and processed samples of nylon fabrics of varying deniers and constructions.

This Example also demonstrates that the invention yields substantial improvement in yarn slippage properties. With reference to Table VII, Sample 3 it will be seen that yarn slippage in the Control and Processed fabrics improved from 77×67 lbs. to 389×404 lbs.

processed at differing energy levels. In general, it was found that increases in cumulative energy applied to the fabric correlated with increased air permeability. Fabrics processed at lower energy levels exhibited decreased air permeabilities.

Table IX sets forth process condition and physical property data for samples of 420, 630 and 840 denier control and processed nylon fabrics.

TABLE VII

| SAMPLE ID | Ends/in (EPI) | Picks/in (PPI) | WT (oz/sq yd) | THICKNESS (mils) | AIR PERM (cfm/sq ft) | GRAB STR warp (lbs) | GRAB STR fill (lbs) | ELONG warp (%) | ELONG fill (%) | TEAR STR warp (lbs) | TEAR STR fill (lbs) |
|---|---|---|---|---|---|---|---|---|---|---|---|
| Sample 1: 48 × 54 420 denier nylon [W4483] | | | | | | | | | | | |
| Control | 48.3 | 54.2 | 6.02 | 13 | 0.44 | 433 | 497 | 39.3 | 31.2 | 43.7 | 44.2 |
| Processed | 55.6 | 60.1 | 7.63 | 17 | 2.1 | 478 | 534 | 51.3 | 52.7 | 32.8 | 32.8 |
| Sample 2: 60 × 60 315 denier nylon [W4479] | | | | | | | | | | | |
| Control | 60.9 | 61.4 | 5.42 | 12 | 0.92 | 450 | 462 | 39 | 28.9 | 29.8 | 31 |
| Processed | 66.2 | 66.2 | 6.21 | 15 | 2.35 | 476 | 486 | 49.2 | 39 | 21.9 | 21.4 |
| Sample 3: 32 × 32 ripstop 840 denier nylon [S/28297]* | | | | | | | | | | | |
| Control | | | 7.7 | 20.1 | 3.88 | 510 | 557 | 34.7 | 37.5 | | |
| Processed | | | 8.1 | 30.3 | 9.31 | 521 | 504 | 32.8 | 44.9 | | |
| Sample 4: 41 × 41 630 denier nylon [S/28274] | | | | | | | | | | | |
| Control | 39.5 | 41.7 | 7.04 | 16 | 1.74 | 542 | 602 | 35.9 | 30.8 | 53.2 | 51.4 |
| Processed | 44.6 | 43.1 | 8.22 | 18 | 6.1 | 612 | 608 | 42.5 | 38.2 | 39.1 | 38.3 |

*Additional Data: Yarn Slippage
Before Treatment: 77 × 67 lbs
After Treatment: 389 × 404 lbs

EXAMPLE 8

Uniform Air Permeability Across Fabric.

Figure 8:
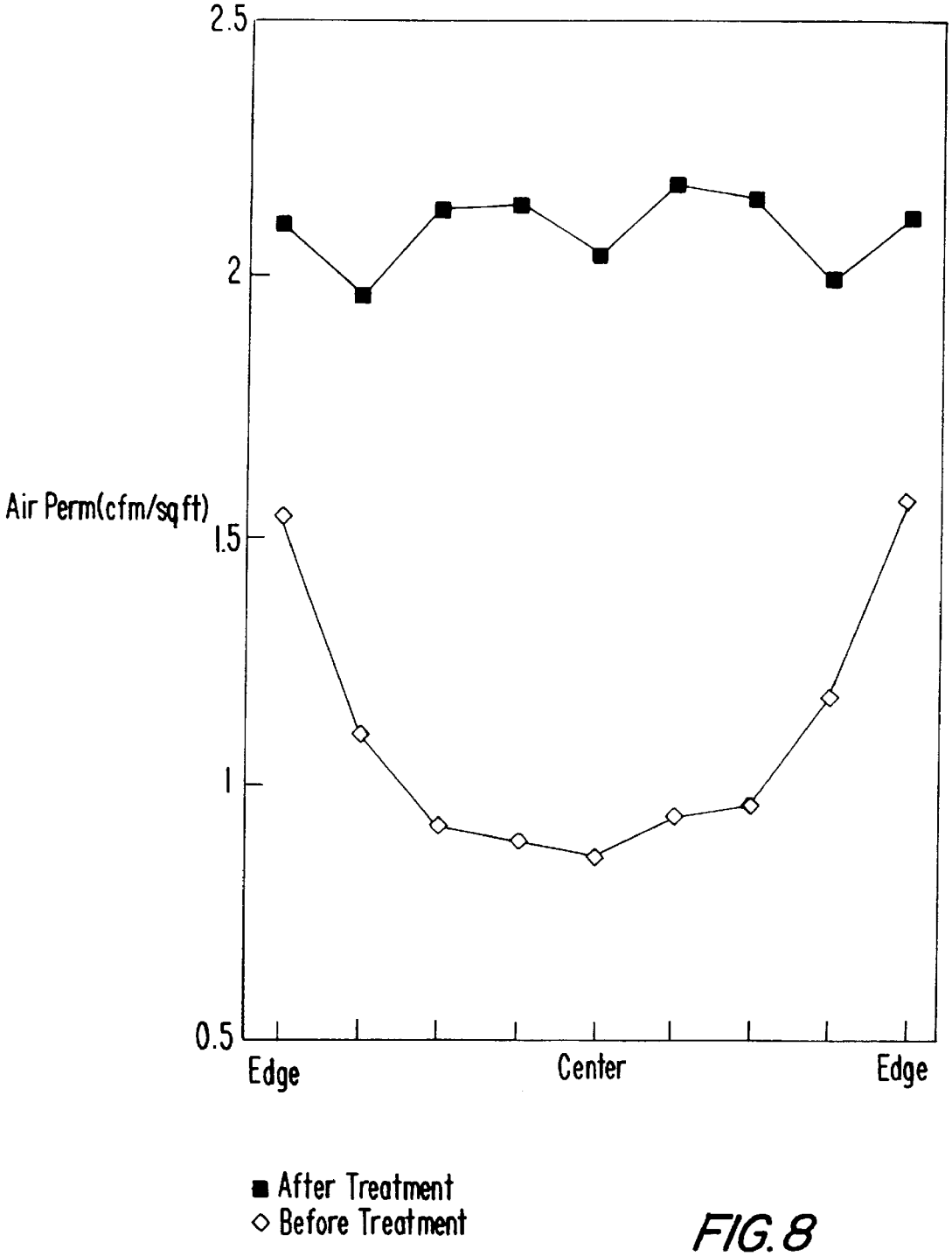
FIG. 8 is a graph of air permeability across the fabric width of a control and hydraulically processed nylon fabric of Example 8 showing uniformly controlled porosity obtained in the invention.
Figure 9A:
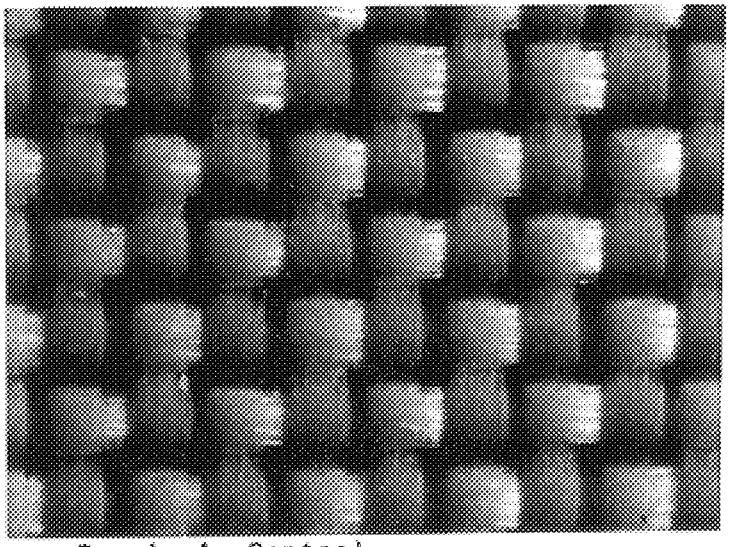
FIGS. 9A–D are photomicrographs at 30× magnification of a control and hydraulically processed glass filament fabric at pressures of 200, 300 and 1500 psi in accordance with Example 10, Sample A.
Figure 9B:
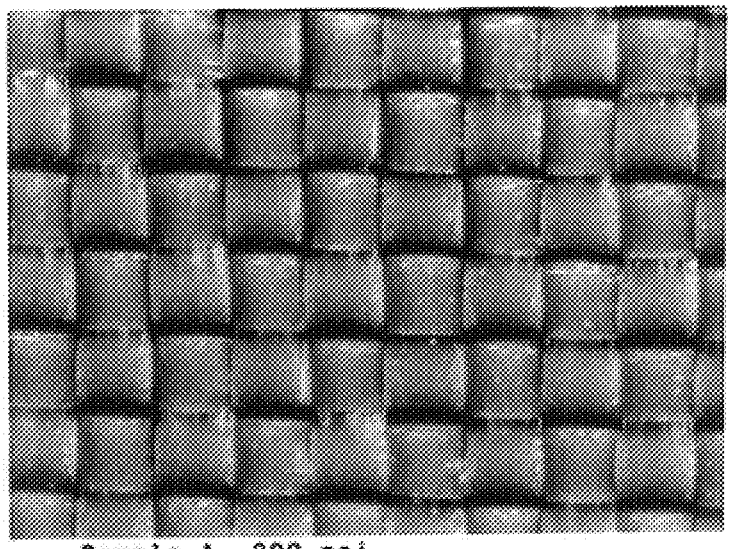
Figure 9C:
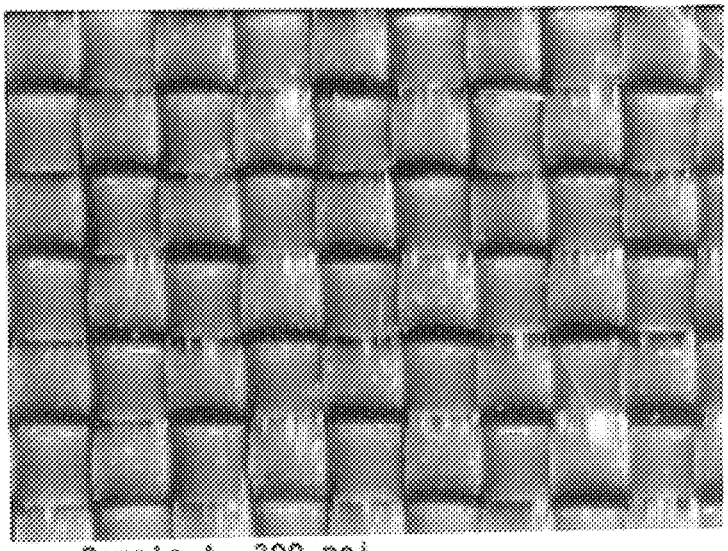
Figure 9D:
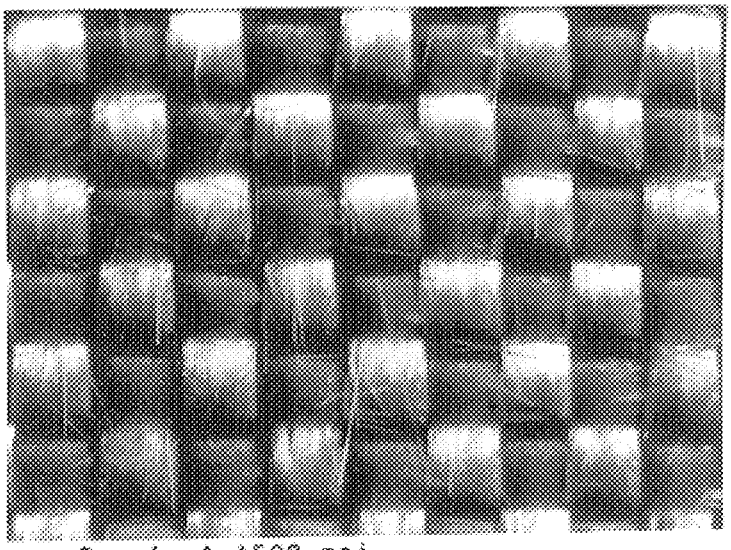

This Example provides a further illustration of uniformity in permeability that may be obtained in the finishing of filament fabrics in the invention process. A control nylon filament fabric having a 52×52 construction and weight of approximately 6.21 oz/yd$^2$ was found to have air permeability which varied across its width, center to outer edges, from approximately 1 to 1.5 cfm/ft$^2$. Hydraulic treatment employing the process parameters of Example 4 yielded a uniform permeability across the fabric of approximately 2 cfm/ft$^2$. This result is illustrated in FIG. 8 which is a graph of air permeability of control and processed fabric as a function of position across the fabric. Table VIII sets forth further physical property data for the control and processed nylon fabric.

EXAMPLE 9

Increased and Decreased Air Permeability.

This Example demonstrates the relationship between process energy and resulting air permeability in finished fabrics. Nylon fabrics having filaments of various deniers were

TABLE VIII

| Fabric Sample | Control | Treated | Change |
|---|---|---|---|
| Count | 52 × 52 | 58 × 57 | |
| Weight (ozpsy) | 6.21 | 7.58 | 22.15% |
| Standard Deviation | 0.01 | 0.05 | |
| Thickness (mils) | 12.6 | 21.0 | 66.40% |

TABLE VIII-continued

| Fabric Sample | Control | Treated | Change |
|---|---|---|---|
| Standard Deviation | 0.11 | 0.62 | |
| Air Perm (cfm/sq. ft) | 1.10 | 2.09 | 90.00% |
| Standard Deviation | 0.27 | 0.08 | |
| Warp Grab Tensile (lbs) | 524.30 | 538.00 | 2.61% |
| Standard Deviation | 13.17 | 7.24 | |
| Weft Grab Tensile (lbs) | 516.92 | 546.10 | 5.64% |
| Standard Deviation | 21.10 | 7.58 | |
| Warp Grab Elong. (%) | 42.13 | 57.60 | 36.72% |
| Standard Deviation | 1.45 | 1.67 | |
| Weft Grab Elong. (%) | 40.27 | 56.00 | 39.06% |
| Standard Deviation | 1.46 | 1.25 | |
| Warp Tongue Tears (lbs) | 33.64 | 26.76 | −20.45% |
| Standard Deviation | 0.85 | 1.42 | |
| Weft Tongue Tears (lbs) | 34.74 | 27.46 | −20.96% |
| Standard Deviation | 0.98 | 1.95 | |

TABLE IX

| SAMPLE ID | Energy (Hp-r/lb) | WT (oz/sq yd) | BULK (mils) | AIR PERM (cfm/sq ft) | PROCESS CONDITIONS (100 × 94 Stainless Steel Screen) Press (PSI) | Speed (FPM) | Orifice #/Size (IN) | PASS | SIDE |
|---|---|---|---|---|---|---|---|---|---|
| Sample 1: 420 denier nylon | | | | | | | | | |
| Control | — | 5.6 | 12.5 | 5.0 | | | | | |
| Increased Air Permeability | .06 | 6.0 | 15.0 | 7.9 | 1000 | 50 | 61/.005 | 1 | 2 |
| Decreased Air Permeability | .008 | 5.8 | 13.0 | 3.8 | 500 | 100 | 104/.0032 | 1 | 2 |
| Sample 2: 630 denier nylon | | | | | | | | | |
| Control | — | 7.0 | 14.5 | 2.1 | | | | | |
| Increased Air Permeability | .04 | 7.8 | 19.0 | 3.7 | 1000 | 50 | 61/.005 | 1 | 2 |
| Decreased Air Permeability | .006 | 7.5 | 17.0 | 1.4 | 500 | 100 | 104/.0032 | 1 | 2 |
| Sample 3: 840 denier nylon | | | | | | | | | |
| Control | — | 7.4 | 16.9 | 6.4 | | | | | |
| Increased Air Permeability | .04 | 8.0 | 21.4 | 7.8 | 1000 | 50 | 61/.005 | 1 | 2 |
| Decreased Air Permeability | .006 | 7.8 | 19.4 | 4.9 | 500 | 100 | 104/.0032 | 1 | 2 |

EXAMPLE 10

Hydraulic Treatment of Glass Filament Fabrics

Hydraulic processing in this Example is employed to engineer smooth, low permeability, glass filament fabrics for use in manufacture of printed circuit boards.

It is known to employ resin coated woven filament fabrics in manufacture of printed circuit boards. Conventional glass filament fabrics comprise a matrix of warp and weft woven filament bundles. (Warp and weft filament bundles are formed by binding or twisting a plurality of monofilaments to form filament yarn.) To obtain smooth surfaces which are required for the printing of circuits, glass fabrics are fabricated from fine yarns in tight constructions.

Hydraulic finishing treatment of this invention permits use of less expensive coarse and open weave filament fabric constructions in the manufacture of filament fabric. Most surprisingly, it was found that "low pressure" hydraulic treatment "spreads" and opens filaments in the fabric to provide an open weave fabric having improved smoothness.

To demonstrate the correlation between pressure treatment, fabric smoothness and permeability, glass filament fabrics were processed at pressures ranging from 200 to 1500 psi. Hydraulic treatment specifications: manifolds having 0.005 inch diameter holes with a density of 61 holes per inch., and a 100×94 stainless steel support screen. Fabrics were processed under three manifolds on both sides. Table X set forth test results for 87 and 167 gm/yd$^2$ fabrics:

TABLE X

| | Weight (gm/yd$^2$) | Thickness (Mils) |
|---|---|---|
| Sample A | | |
| Control | 87.08 | 4.7 |
| 200 psi | 82.47 | 4.9 |
| 300 psi | 82.87 | 4.9 |
| 1500 psi | 86.00 | 8.0 |

TABLE X-continued

| | Weight (gm/yd$^2$) | Thickness (Mils) |
|---|---|---|
| Sample B | | |
| Control | 166.95 | 9.6 |
| 200 psi | 161.13 | 9.1 |
| 300 psi | 157.23 | 9.1 |
| 400 psi | 156.37 | 9.4 |
| 1500 psi | 171.61 | 12.1 |

FIGS. 9A–D show photomicrographs at a 30× magnification of control and the hydraulically processed Sample A fabrics. Similar results were obtained for the heavy weight Sample B fabric. It will be seen that hydraulic treatment evenly spreads and flattens the filament yarn fabric to provide a smooth finish. Optimal results are obtained at the lowest 200 psi treatment. As an adjunct to improved smoothness, the finishing process also obtains reduced permeability in the fabric. At a 200 psi treatment, it was found fabric permeability was uniformly reduced from 62 to 1.5 cfm/ft$^2$. High pressure treatments in the approximate range of 400 psi and higher caused breakage in monofilaments in the yarn which is disadvantageous for circuit board fabric applications.

In the foregoing Examples, the hydraulic treatment process of the invention is shown to yield improved uniformity in fabric weave. More particularly, it is shown that the invention process stabilizes the fabric matrix and obtains improvements in fabric properties including, cover, opacity, increased or decreased bulk, increased or decreased air permeability, abrasion resistance, tensile strength, edge fray, and seam slippage.

Further, advantageous fabric features are obtained in particular material applications of the invention process. For example, it has been found that hydraulic treatment of texturized fabrics yields substantial improvements in seam strength and abrasion resistance. The improvement in seam strength is obtained as a result of entanglement of coil or crimped portions of warp and filling yarn in the fabric. The abrasion resistance improves because the hydraulic treatment drives any free filament lengths on the surface of the yarn, i.e., filament bundles, into the yarn body.

Hydraulic processing according to the invention also obtains a texturizing effect in filament fabrics. It will be recognized that this texturizing feature presents a substantial advantage as compared to conventional techniques in which individual yarns are processed prior to weaving. Finally, as a further feature, it is found that the invention process effectively reduces the luster of filament fabrics such as cellulose acetate.

Thus, the invention provides a method and apparatus for finishing filament materials by application of a continuous non-compressible fluid curtain against support screens. A wide range of fabric properties can be upgraded or obtained for desired fabric applications. The hydraulic treatment technique of the invention upgrades the fabric by uniformly spacing filament yarn in the fabric. Additionally, the production line of the invention provides an in-line capability to coat or impregnate processed fabrics with various conventional resins, softeners, and repellants for specified end uses. Further pre-and post treatment processes may also be employed, for example, soft and caustic scouring to remove oil, sizing and dirt. Pre-tentering and post-heat setting tentering may also be used to stretch, shrink and heat set the fabric.

Other modes of hydroprocess treatment may be devised in accordance with principles of the invention. Thus, although the invention employs two hydraulic modules in the process line, additional modules are within the scope of the invention. Advantage would also be obtained by provision of a pre-treatment hydraulic module for opening fabric yarns prior to pre-tentering. See FIG. 2. Similarly, although, columnar jets are preferred for use in the invention fluid curtain, other jet types are within the scope of the invention. For example, advantage may be obtained by use of a fluid curtain which includes divergent or fan jets. Hydraulic fluid treatment systems which include fan jets are described in commonly owned U.S. Pat. Nos. 4,960,630 and 4,995,151 which are incorporated herein by reference.

Divergent jet systems are advantageous insofar as angled fluid streams, which overlap, effect a uniform processing of the fabric. Where divergent jets are employed it is preferred that the jets have an angle of divergence of approximately 2–45 degrees and spacing from the support screen of 2.54 to 25.4 cm (1 to 10 inches) to define an overlapping jet array. Experimentation has shown that a divergence angle of about 18 degrees yields an optimum fan shape and an even curtain of water pressure.

Similarly, although the preferred line employs support members or screens which have a generally planar configuration, it will be appreciated that contoured support members and/or drum support modules may be used in the invention.

Other variations of structures, materials, products and processes may of course be devised. All such variations, additions, and modifications are nevertheless considered to be within the spirit and scope of the present invention, as defined in the claims appended hereto.

We claim:

1. A method for finishing filament fabric, the method comprising the steps of:

providing a textile fabric consisting of continuous filament warp and filling yarns formed by interlacing of the yarns;

supporting the fabric on a support member; and uniformly and continuously impacting at least one side of the fabric with a continuous curtain of fluid having a sufficient energy in the range of $1.1466\times10^4$–$22.932\times10^6$ (0.002–4.0 hp-hr/lb) to impart a controlled porosity correlating to a uniformity of the yarn spacing within the fabric.

2. A method according to claim 1, which further comprises providing the uniform and continuous curtain of fluid by an array of densely spaced liquid jets which emanate from jet orifices.

3. A method according to claim 2, further comprising the step of conveying the fabric in a machine direction through a production line, and aligning the liquid jets in a cross-direction relative to the machine direction.

4. A method according to claim 3, which further comprises providing the support member with a fine mesh screen arranged in offset relation to the machine direction.

5. A method according to claim 3, which further comprises providing each of the liquid jets with an axis substantially perpendicular to the fabric.

6. A method according to claim 3, which further comprises providing each of the liquid jets with an angular orientation offset from an axis substantially perpendicular to the fabric.

7. A method according to claim 3, which further comprises providing the array of jets by a plurality of parallel manifolds.

8. A method according to claim 7, which further comprises providing the jets with columnar configurations, the jet orifices having a diameter of 0.0081 to 0.0229 cm (0.0032 to 0.009 inches), and center-to-center spacing of 0.0244 to 0.0635 cm (0.0096 to 0.025 inches).

9. A method according to claim 8, which further comprises providing the jets with a spacing approximately 1.27 to 2.54 cm (0.5 to 1 inches) from the support member, and spacing the manifolds approximately 20.3 cm (8 inches) apart.

10. A method according to claim 9, which further comprises providing the fabric with a conveying speed from 0.0508 to 4.064 m/sec (10 to 800 fpm), and providing said curtain of fluid with a jet pressure from 689 to 20,685 Kpa (100 to 3000 psi.

11. A method according to claim 9, which further comprises providing each of the liquid jets with an axis offset from the perpendicular.

12. A method according to claim 2, further comprising the step of conveying the fabric through the continuous curtain of fluid at a speed from 0.0508 to 4.064 m/sec (10 to 800 fpm), and providing the curtain of fluid at a jet pressure from 689 to 20,685 Kpa (100 to 3000 psi).

13. A method according to claim 2, which further comprises providing the jets with columnar configurations, the jet orifices having a diameter of 0.0081 to 0.0229 cm (0.0032 to 0.009 inches), and center-to-center spacing of 0.0244 to 0.0635 cm (0.0096 to 0.025 inches).

14. A method according to claim 2, which further comprises providing the jets with divergent fan sprays having an angle of divergence so as to provide overlapping jets of liquid.

15. A method according to claim 14, which further comprises providing the jets with an angle of divergence of 2–45 degrees.

16. A method according to claim 14, which further comprises providing the jets with a spacing about 2.54 to 25.4 cm (1 to 10 inches) above the support member.

17. A method according to claim 16, which further comprises providing the jets with an angle of divergence of 18 degrees.

18. A method for finishing filament fabric, the method comprising the steps of:

providing a textile fabric consisting of continuous filament warp and filling yarns formed by interlacing of the yarns;

supporting the fabric on a support member;

providing the support member with liquid pervious open areas in a fine mesh pattern which permits fluid passage without imparting a patterned effect to the fabric; and uniformly and continuously impacting at least one side of the fabric with a continuous curtain of fluid having a sufficient energy to impart a controlled porosity correlating to a uniformity of the yarn spacing within the fabric.

19. A method for finishing filament fabric, the method comprising the steps of:

providing a textile fabric consisting of continuous filament warp and filling yarns formed by interlacing of the yarns;

shrinking the fabric a specified width;

pre-tentering the fabric to stretch it to a predetermined excess width;

selecting the pre-tentering excess width so that the fabric shrinks to a width slightly less than a desired finished width for output fabric; and supporting the fabric on a support member, and uniformly and continuously impacting at least one side of the fabric with a continuous curtain of fluid having a sufficient energy to impart a controlled porosity correlating to a uniformity of the yarn spacing within the fabric.

20. A method according to claim 19, which further comprises treating the fabric on both sides with the continuous fluid curtain.

21. A method according to claim 19, further comprising the step of post-tentering the fabric after the fluid treatment to a desired output width.

22. A method according to claim 19, which further comprises providing the continuous curtain of fluid with an energy in the range of $1.1466\times10^4$–$22.932\times10^6$ joule/kg (0.002–4.0 hp-hr/lb).

23. A method according to claim 19, which further comprises providing the uniform and continuous curtain of fluid by an array of densely spaced liquid jets which emanate from jet orifices.

24. A method according to claim 23, which further comprises providing the jets with columnar configurations.

25. A method according to claim 23, which further comprises providing the jets with divergent fan sprays having an angle of divergence so as to provide overlapping jets of liquid.

26. A method for finishing filament fabric, the method comprising the steps of:

providing a textile fabric consisting of continuous filament warp and filling yarns formed by interlacing of the yarns;

pre-tentering the fabric to stretch it to a predetermined excess width; and supporting the fabric on a support member;

providing a uniform and continuous curtain of fluid by an array of densely spaced liquid jets which emanate from jet orifices;

providing each of the liquid jets with an axis substantially perpendicular to the fabric; and uniformly and continuously impacting at least one side of the fabric with a continuous curtain of fluid having a sufficient energy to impart a controlled porosity correlating to a uniformity of the yarn spacing within the fabric.

27. A method for finishing filament fabric, the method comprising the steps of:

providing a textile fabric consisting of continuous filament warp and filling yarns formed by interlacing of the yarns;

conveying the fabric in a machine direction through a production line;

pre-tentering the fabric to stretch it to a predetermined excess width;

supporting the fabric on a support member;

providing the support member with a fine mesh screen arranged in offset relation to the machine direction; and uniformly and continuously impacting at least one side of the fabric with a continuous curtain of fluid having a sufficient energy to impart a controlled porosity correlating to a uniformity of the yarn spacing within the fabric.

28. Apparatus for finishing textile fabric having filament yarns which are interlaced at cross-over points to define interstitial open areas, the apparatus comprising:

a conveyor for conveying the textile fabric to a fluid treatment station along a machine direction, the conveyor including a support surface for the fabric;

a fluid means for uniformly impacting the conveyed fabric in a fluid treatment station with a continuous curtain of fluid comprising a plurality of densely spaced liquid jets, said liquid jets emanating from a plurality of jet orifices having a diameter of 0.0081 to 0.0229 cm (0.0032 to 0.009 inches), and center-to-center spacing of 0.0244 to 0.0635 cm (0.0096 to 0.025 inches);

wherein each of the liquid jets has an angular orientation offset from an axis substantially perpendicular to the fabric;

said continuous fluid curtain providing a sufficient energy in the range of $1.1466\times10^4$–$22.932\times10^6$ joule/kg (0.002–4.0 hp-hr/lb) to impart a controlled porosity to the fabric.

29. An apparatus according to claim 28, wherein the jets are provided by a plurality of parallel manifolds.

30. An apparatus according to claim 28, wherein said jet orifices are arranged in generally parallel spaced rows.

31. An apparatus according to claim 30, wherein the spacing of the jet orifices in said rows are staggered from row to row.

32. Apparatus according to claim 28, wherein the jets have a density in the approximate range of 61 to 208 holes per inch.

33. Apparatus for finishing filament fabric consisting of continuous filament warp and filling yarns which are interlaced at cross-over points to define interstitial open areas, the apparatus comprising:

a conveyor for conveying the textile fabric to a fluid treatment station along a machine direction, the conveyor including a support surface for the fabric;

a fluid means for uniformly impacting the conveyed fabric in a fluid treatment station with a continuous curtain of fluid comprising a plurality of densely spaced liquid jets, said liquid jets emanating from a plurality of jet orifices having a diameter of 0.0081 to 0.0229 cm (0.0032 to 0.009 inches), and center-to-center spacing of 0.0244 to 0.0635 cm (0.0096 to 0.025 inches);

said continuous fluid curtain providing a sufficient energy in the range of $1.1466\times10^4$–$22.932\times10^6$ joule/kg (0.002–4.0 hp-hr/lb) to impart a controlled porosity to the fabric; and further comprising a pre-tenter station positioned before the fluid treatment station for stretching the fabric to a pre-determined excess width.

34. An apparatus according to claim 33, further comprising a post-tenter station positioned after the fluid treatment station for stretching the fabric to an output finished width.

35. A method for finishing textile fabric including warp and filling filament yarns formed by interlacing of the yarns, the method comprising the steps of:

supporting the fabric on a support member, conveying the fabric in a machine direction through a production line at a speed from 0.0508 to 4.064 m/sec (10 to 800 fpm) , and uniformly and continuously impacting at least one side of the fabric with a continuous curtain of fluid provided by an array of densely spaced liquid jets which emanate from jet orifices, providing said curtain of fluid with a jet pressure from 689 to 20,685 Kpa (100 to 3000 psi) and a sufficient energy in the range of $1.1466\times10^4$–$22.932\times10^6$ joule/kg (0.002–4.0 hp-hr/lb) to impart a controlled porosity to the fabric.

36. A method according to claim 35, which further comprises providing the jets with columnar configurations, the jet orifices having a diameter of 0.0081 to 0.0229 cm (0.0032 to 0.009 inches), and center-to-center spacing of 0.0244 to 0.0635 cm (0.0096 to 0.025 inches).

37. A method according to claim 35, which further comprises providing the jets with divergent fan sprays having an angle of divergence so as to provide overlapping jets of liquid.

38. A method according to claim 37, which further comprises providing the jets with an angle of divergence of 2–45 degrees.

39. A method according to claim 37, which further comprises providing the jets with a spacing about 2.54 to 25.4 cm (1 to 10 inches) above the support member.

40. A method according to claim 39, which further comprises providing the jets with an angle of divergence of 18 degrees.

41. A method according to claim 35, which further comprises providing the support member with liquid pervious open areas in a fine mesh pattern which permits fluid passage without imparting a patterned effect to the fabric.

42. A method according to claim 35, which further comprises aligning the liquid jets in a cross-direction relative to the machine direction.

43. A method according to claim 35, which further comprises providing the support member with a fine mesh screen arranged in offset relation to the machine direction.

44. A method according to claim 43, which further comprises providing each of the liquid jets with an axis substantially perpendicular to the fabric.

45. A method according to claim 43, which further comprises providing each of liquid jets with an angular orientation offset from an axis substantially perpendicular to the fabric.

46. A method according to claim 35, comprising the further step of pre-tentering the fabric to stretch it to a predetermined excess width, wherein the fluid treatment step shrinks the fabric a specified width, and the pre-tentering excess width is selected so that the fabric shrinks to a width slightly less than a desired output width for the fabric.

47. A method according to claim 35, further comprising the step of post-tentering the fabric after the fluid treatment to a desired output width.

48. A method according to claim 35, further comprising treating the fabric on both sides with said continuous fluid curtain.

49. A method according to claim 43, which further comprises providing the support member with a fine mesh screen arranged in offset relation to the machine direction.

* * * * *